US005484170A

United States Patent [19]

Hatfield, Jr.

[11] Patent Number: 5,484,170

[45] Date of Patent: Jan. 16, 1996

[54] UNITARY SHIPPING LABEL, PRODUCT INFORMATION LABEL AND PACKING SLIP

[75] Inventor: Raymond Hatfield, Jr., Waynesville, Ohio

[73] Assignee: Intermec Incorporated, Everett, Wash.

[21] Appl. No.: 289,954

[22] Filed: Aug. 10, 1994

[51] Int. Cl.[6] ..... B42D 15/00

[52] U.S. Cl. ..... 283/79; 283/80; 283/81

[58] Field of Search ..... 283/72, 79, 80, 283/81, 116, 101, 55; 462/64, 65

[56] References Cited

U.S. PATENT DOCUMENTS

| | | | |
|---|---|---|---|
| 3,987,960 | 10/1976 | Gardiner | 283/79 X |
| 5,002,311 | 3/1991 | Brunjes | 283/79 X |
| 5,238,272 | 8/1993 | Taylor | 283/79 |
| 5,421,778 | 6/1995 | Kouramanis | 283/79 X |

*Primary Examiner*—Willmon Fridie, Jr.
*Attorney, Agent, or Firm*—M. Michael Carpenter; L. David Rish; Donald A. Streck

[57] ABSTRACT

A unitary shipping label, product information label, and packing slip for an article to be shipped comprises an adhesive label strip having a first panel portion, a second panel portion, a third panel portion, and a fourth panel portion. Addressee information and product identification information are printed on the first panel portion and packing list information is printed on the remaining panel portions as necessary. The releasable liner has perforations and slits therethrough defining the panel portions and top and bottom removable strips for the second and fourth panel portions. In use, the top and bottom removable strips for the fourth panel portion are removed, the fourth panel portion is folded over the third panel portion, and the fourth panel portion and the third panel portion in combination are folded over the second panel portion adhesively attaching the fourth panel portion to the second panel portion along their top and bottom edges. The releasable liner is removed from the first panel portion and the top and bottom removable strips of the second panel portion and the unitary shipping label, product information label, and packing slip as thus folded and with portions of the releasable liner thereof as thus removed is adhesively attached to the article to be shipped. At the receiving site, the packing list portion of the second, third, and fourth panel portions are removed along the perforations and unfolded. Sender information and use information for the sender and receiver are pre-printed on the front and back.

14 Claims, 5 Drawing Sheets

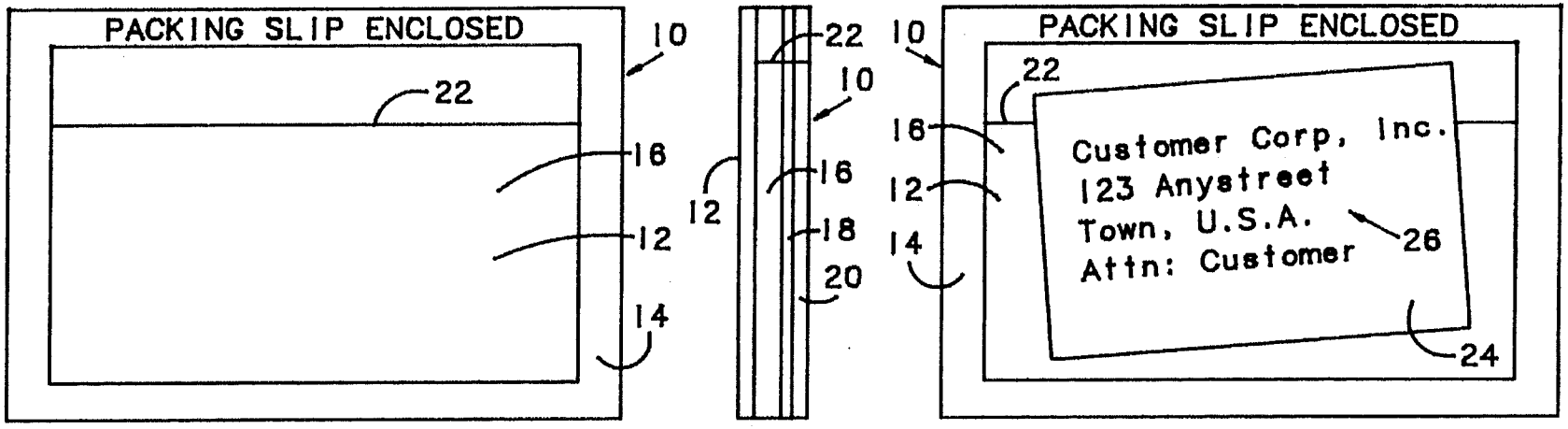
PRIOR ART FIG. 1
PRIOR ART FIG. 2
PRIOR ART FIG. 3
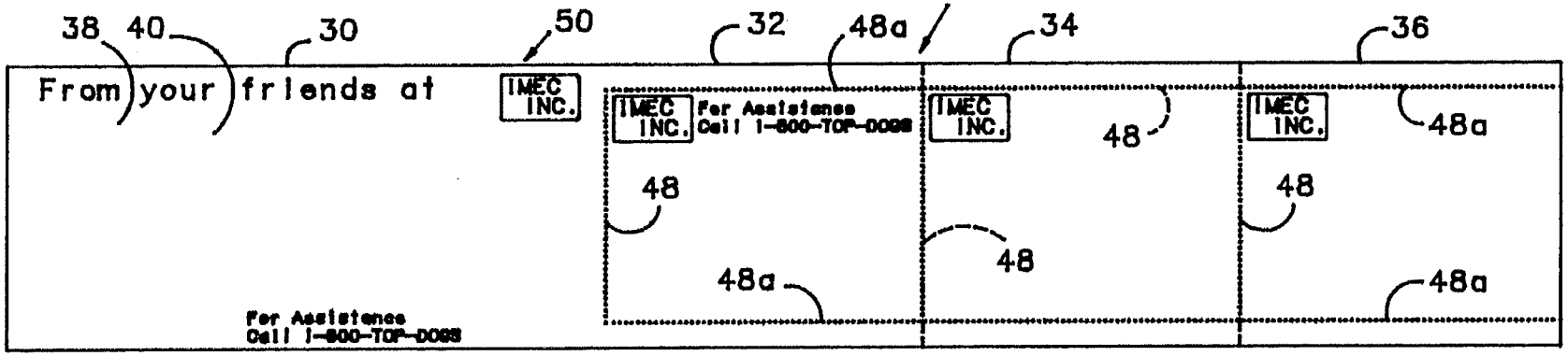
FIG. 4

UNITARY SHIPPING LABEL, PRODUCT INFORMATION LABEL AND PACKING SLIP

BACKGROUND OF THE INVENTION

1. Technical Field

This invention relates to adhesive shipping labels, product information labels, and packing slip containers for attachment to articles for shipment purposes and, more particularly, to a unitary shipping label, product information label, and packing slip for an article to be shipped comprising, an adhesive label strip including an adhesive layer and a releasable liner covering the adhesive layer and comprising a first panel portion, a second panel portion, a third panel portion, and a fourth panel portion; addressee information and product identification information printed on the first panel portion; packing list information printed on at least one of the second panel portion, the third panel portion, and the fourth panel portion; the releasable liner having transverse perforations therethrough at junctions of the first panel portion, the second panel portion, the third panel portion, and the fourth panel portion; the releasable liner having a pair of longitudinal perforations and corresponding slits therethrough defining top and bottom removable strips for the second panel portion and the fourth panel portion; the top and bottom removable strips for the fourth panel portion being removed; the fourth panel portion being folded over the third panel portion; the fourth panel portion and the third panel portion in combination being folded over the second panel portion adhesively attaching the fourth panel portion to the second panel portion along top and bottom edges thereof; the releasable liner being removed from the first panel portion and the top and bottom removable strips of the second panel portion being removed; and, the unitary shipping label, product information label, and packing slip as thus folded and with portions of the releasable liner thereof as thus removed being adhesively attached to the article to be shipped.

2. Background Art

In the commercial shipping of articles, there is typically a packing slip listing the articles enclosed, a product information label permanently affixed to the container, and a shipping label indicating the address to which the article is to be shipped. This has been accomplished according to prior art techniques in several ways.

For one, the packing list as typed up by hand or computer can be enclosed in the box, bag, or other container being shipped along with the shipped items themselves, a separate product information label attached to the outside of the container, and a separate shipping label attached to the outside of the container. This has the disadvantage that if for any reason it is desired to know detailed information regarding what is inside, the container must be opened.

Thus, it has become more common to attach a packing slip envelope to the outside of the container. A closed envelope, separate product information label, and separate shipping label could be used; but, it has become more common for apparent convenience reasons to employ a transparent-fronted, adhesive-backed, packing slip container 10 as depicted in FIG. 1. As shown in FIG. 2, the container 10 comprises a clear plastic front panel 12 attached about its periphery at 14 to a backing piece of paper or light cardboard 16. The other side of the backing 16 has adhesive 18 covered with a releasable protective covering 20. A slit 22 through the backing 16, adhesive 18, and protective covering 20 allows a folded packing slip 24 to be inserted into the space between the front panel 12 and the unattached middle of the backing 16 as depicted in FIG. 3. The address 26 of the addressee is typed in a pre-established location of the packing slip 24 so that when the packing slip 24 is folded in a pre-established manner, the address 26 will be visible through the "window" of the front panel 12. Thus, a separate shipping label can be avoided, if desired, but a separate product information label is still required.

The above-described prior art approach has several disadvantages. The packing slip containers 10 are, obviously, not an insignificant expense due to the necessary construction. They must be separately stored in the shipping department of the sending company and separately ordered. If the supply runs out, the shipping process must, of necessity, grind to a halt until an additional supply can be obtained. The packing list including the address of the addressee is typically prepared by a separate department in a separate location and must be delivered to the shipping department. Time must be taken to fold the packing list in the correct manner and insert it properly in order to assure that the address is visible. A product information label must also be produced, usually on a separate printing device which is sometimes in a different location. This label must be matched to the shipping label and packing list prior to shipment of the container. Upon receipt, the plastic of the front panel is, of necessity, tough so as to withstand the rigors of shipment and, therefore, a knife or scissors are usually necessary to remove the packing slip without tearing a fingernail.

The assignee company of the present invention makes computer-driven label printers that can print shipping labels from rolled, fan-folded, or other continuous stock right at the shipping department or other location. The printers could as easily print packing list, shipping, and product information label at the same location if provision was made therefor.

Wherefore, it is an object of the present invention to provide a unitary shipping label, product information label, and packing list that can be printed simultaneously at a single location.

It is another object of the present invention to provide a unitary shipping label and packing list that does not require a separate envelope to contain it.

It is still another object of the present invention to provide a unitary shipping label, product information label, and packing list wherein the packing list is easily retrievable at the receiving location.

It is yet another object of the present invention to provide a unitary shipping label, product information label, and packing list that can be printed on a common printer.

It is a further object of the present invention to provide a unitary shipping label, product information label, and packing list that are supplied in rolled stock, fan-folded, or other continuous supply configurations.

Other objects and benefits of this invention will become apparent from the description which follows hereinafter when read in conjunction with the drawing figures which accompany it.

SUMMARY OF THE DISCLOSURE

The foregoing objects have been attained by the unitary shipping label, product information label, and packing slip of the present invention comprising, a first strip of a printable medium having a front face and a back face; a second strip of a printable medium having a front face and a back face, the first strip being placed over the second strip in alignment with the back face of the first strip facing the front face of the second strip; a layer of adhesive covering the back face of the first strip; a layer of adhesive release material covering the front face of the second strip whereby the first strip is adhesively held to the second strip by the adhesive but the second strip can be released and removed from the adhesive at the junction of the release material with the adhesive; the second strip having transverse perforations therethrough defining first, second, third, and fourth panels; and, the second strip having a pair of longitudinal perforations with corresponding slits therethrough defining top and bottom removable strips for the second, third, and fourth panels.

In the preferred embodiment, the front face of the first strip has sender identifying information pre-printed thereon, the front face of the first panel of the first strip includes an address label portion for the printing of addressee information thereon and an area for printing of product identification information, the front face of the second panel, the third panel, and the fourth panel of the first strip includes a packing list portion for the printing of packing list information and product identification information thereon, and the back face of the second panel of the second strip has receiver use information for releasing the packing list portion pre-printed thereon.

In use after printing the address, product information label, and packing list information, the top and bottom removable strips of the fourth panel are removed exposing the adhesive, the fourth panel is folded over the third panel, and the fourth panel and the third panel in combination are folded over the second panel adhesively attaching the fourth panel to the second panel along top and bottom edges thereof and placing the receiver use information for releasing the packing list portion adjacent the addressee information. The second strip is removed from the first panel and the top and bottom removable strips of the second panel are removed exposing the adhesive and the unitary shipping label, product information label, and packing slip as thus folded is adhesively attached to an article to be shipped.

BRIEF DESCRIPTION OF THE DRAWINGS

FIG. 1 is a simplified drawing of a prior art adhesive-backed packing slip container.

FIG. 2 is an edge view of the container of FIG. 1 not to scale.

FIG. 3 is a drawing showing how a packing slip is placed in the container of FIG. 1 so as to also serve as a shipping label.

FIG. 4 is a front view of the present invention.

DETAILED DESCRIPTION OF THE PREFERRED EMBODIMENT

Figure 5:
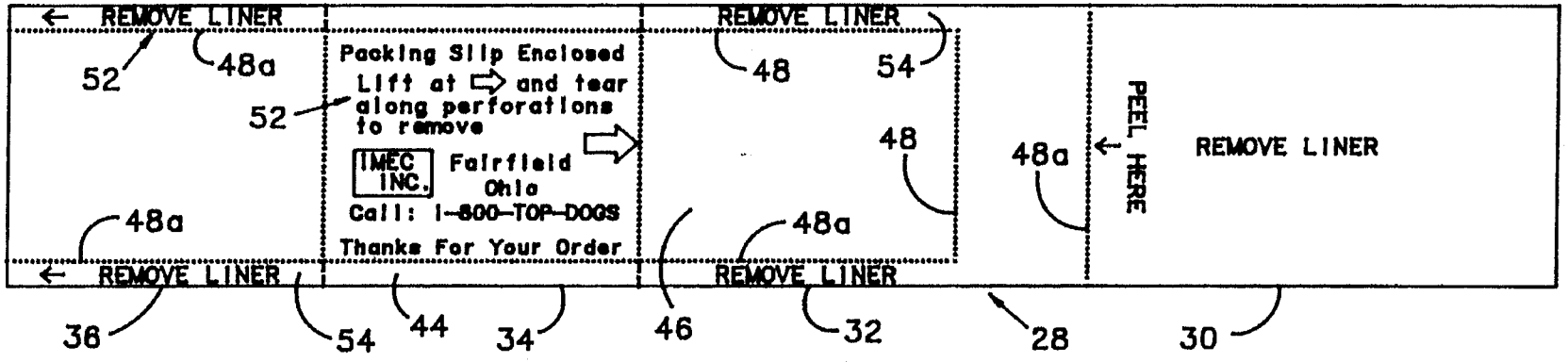
FIG. 5 is a back view of the present invention.

The combined address label and packing list of the present invention comprises a strip 28 of multiple panels. In the preferred embodiment as depicted, there are four panels labeled 30, 32, 34, and 36, respectively. As will be recognized by those of ordinary skill in the art the scope and spirit of the present invention could be accomplished by other appropriate numbers of panels. In the strip 28 as shown in FIGS. 4 through 13 now to be described in detail, panel 30 is the shipping label and product identification information panel, while panels 32, 34, and 36 are the packing list panels.

The strip 28 in its entirety is comprised of a front sheet 38 having a face 40 adapted for printing upon. In the preferred embodiment, the face 40 is printed upon by direct thermal or thermal transfer printing techniques; however, the present invention is applicable with all other continuous printing methods. The only criteria is that the face 40 should accept and hold the printing medium employed by the printer being used and avoid flaking or loss thereof during the rigors of transit and shipping. The back side of the front sheet 38 opposite the face 40 carries an appropriate contact adhesive 42 being one of several such adhesives well known to those skilled in the label art. The back side should be of the usual material of labels which adheres well to the adhesive 42 to maintain the strip 28 in place after placement.

The exposed side of the adhesive 42 is covered by a strip of silicone release liner 44, or the like, again of any of those well known to those of ordinary skill in the label art. The release liner 44 on the side opposite that facing the adhesive 42 is also a printable face 46. The face 46 is printed upon and the release liner 44 is die cut, perforated, and slit in a manner now to be described so as to effect the objects of the present invention.

The face 40 and the release liner 44 have perforations 48 therein which form fold lines and separation lines for the four panels 30, 32, 34, and 36. The face 40 within the four panels 30, 32, 34, and 36 has pre-printed sender information 50 as depicted in FIG. 4. The face 46 contains pre-printed use information 52 for the sender and receiver as depicted in FIG. 5. As also shown in FIG. 5, the back of release liner 44 has slits at **48*a* that correspond to perforations 48 forming top and bottom separately removable strips 54 of the release liner 44 for the three panels 32, 34, and 36**. The use of the present invention in its preferred embodiment as shown will now be described in detail.

Figure 6:
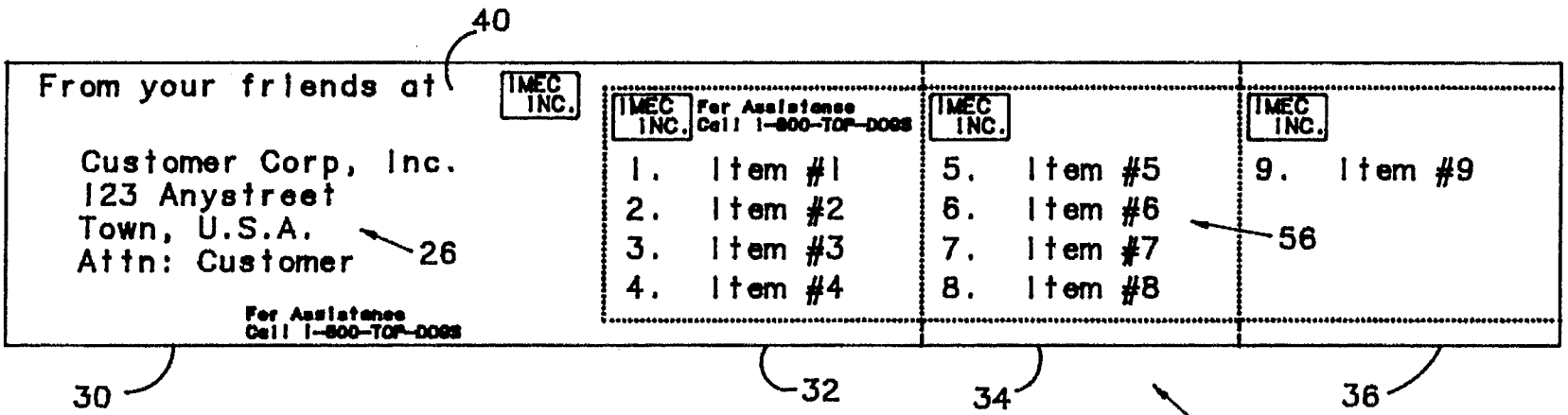
FIG. 6 shows the present invention with the shipping label and packing slip portions filled out prior to folding.

As shown in FIG. 6, the address 26 of the addressee is printed on the face 40 of panel 30, product identification information is printed in the right-most portion of panel 30, and the packing information 56 is printed on the face 40 of panels 32, 34, and 36, as necessary, in a single pass of the printer employed. They could, of course, be printed separately, if desired. Printing in a single pass on a common printer is preferred and an object of the invention.

Figure 7:
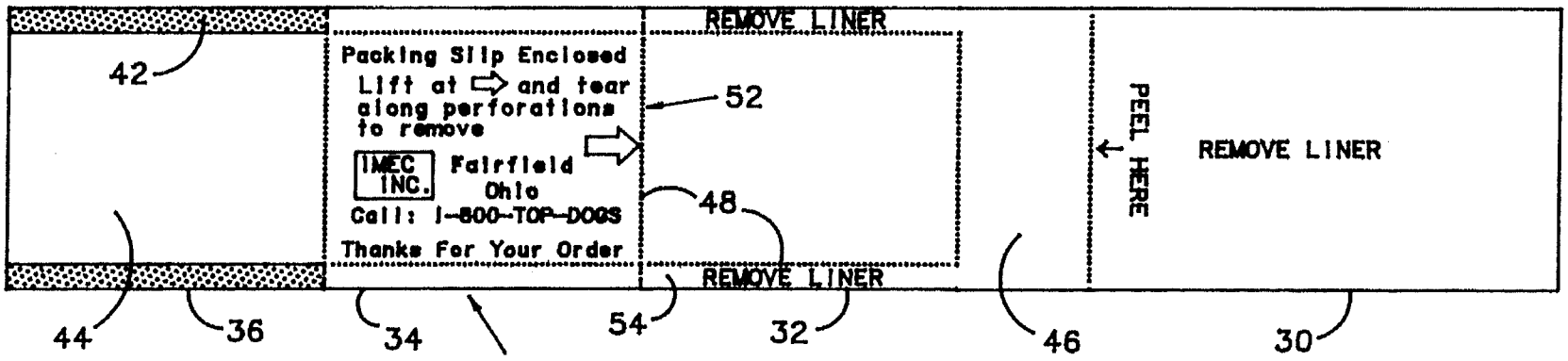
FIG. 7 shows the present invention from FIG. 6 with the left-most panel's top and bottom backing strips removed to expose the adhesive.
Figure 8:
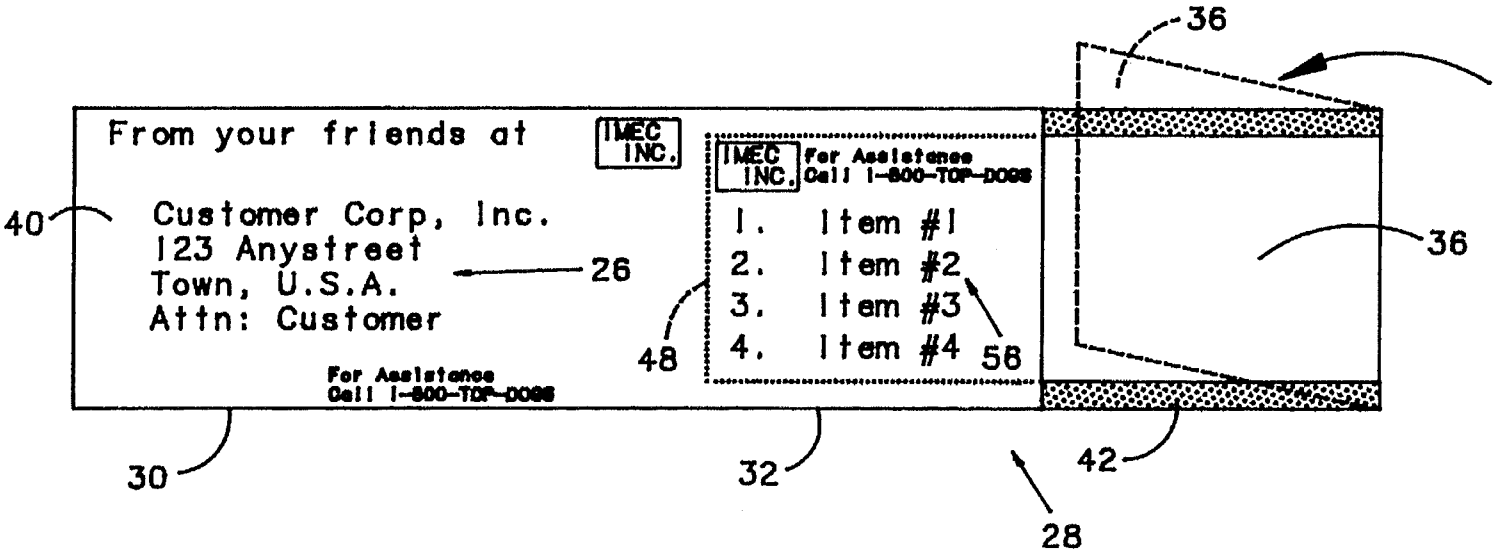
FIG. 8 shows the present invention from FIG. 7 with the left-most panel (on the right in this figure) folded over the adjacent panel as is the first step in folding the present invention.
Figure 9:
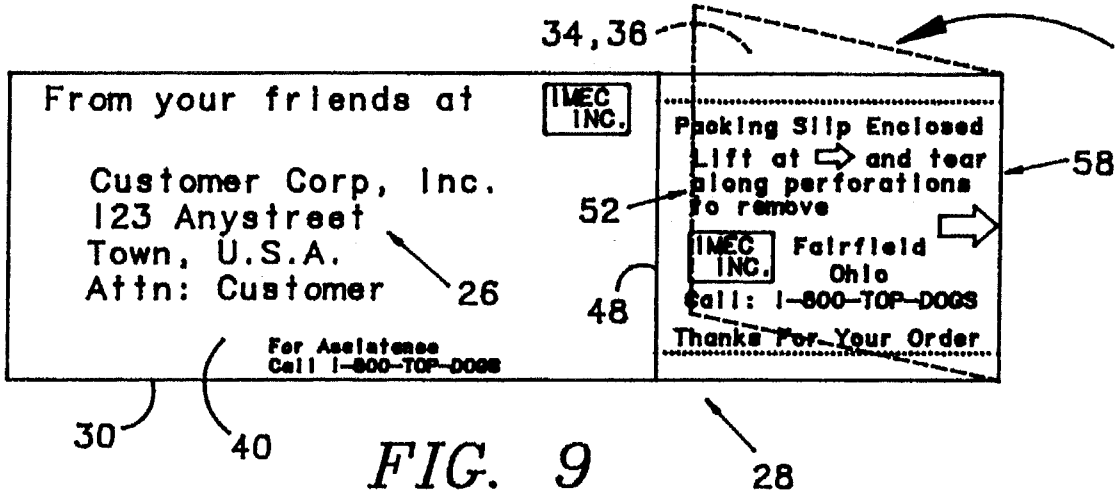
FIG. 9 shows the present invention from FIG. 8 with the two previously folded panels folded over the next adjacent panel as is the second step in folding the present invention.

As shown in FIG. 7, the strips 54 of panel 36 are removed to expose the adhesive 42 at its top and bottom edges. Panel 36 is then folded over panel 34 as shown in FIG. 8 and the combined panels 36, 34 are folded over panel 32 as shown in FIG. 9 forming a sealed packing list packet 58 as the result of the adhesive 42 at the top and bottom edges of panel 36 adhering to the top and bottom edges of the face 40 of panel 32. As will be noted from FIG. 9 as well, the use information 52 describing how to retrieve the packing list is now located on the front adjacent the address 26.

Figure 10:
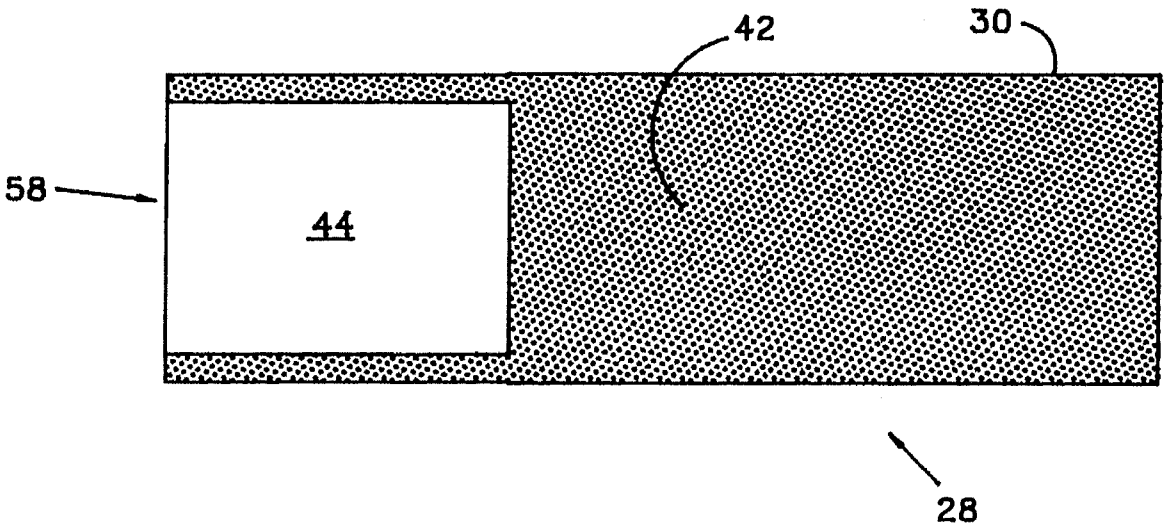
FIG. 10 shows the back of the present invention from FIG. 9 following the removal of the top and bottom edge backing of the third panel and the complete backing of the shipping label panel prior to applying the present invention to an article to be shipped.
Figure 11:
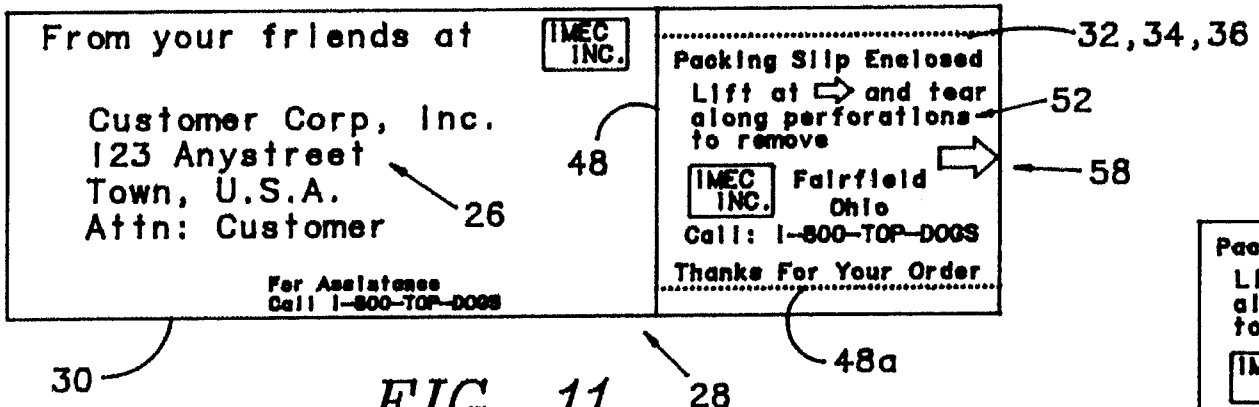
FIG. 11 shows how the present invention looks when applied to an article for :shipping.

The remaining strips 54 and entire release liner 44 on the back of panel 30 is then removed as depicted in FIG. 10. Thus, the release liner 44 only remains covering the adhesive on the back of the packing list packet 58. The combined panel 30 and packing list packet 58 are then adhesively attached to the article to be sent and appear as shown in FIG. 11.

Figure 12:
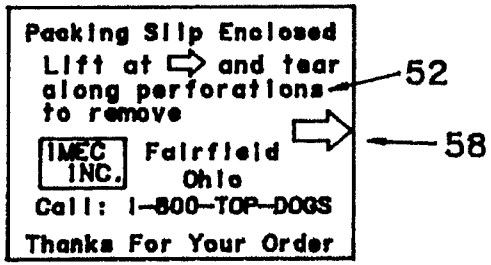
FIG. 12 shows the packing slip portion comprising the three folded panels after removal from the article.
Figure 13:
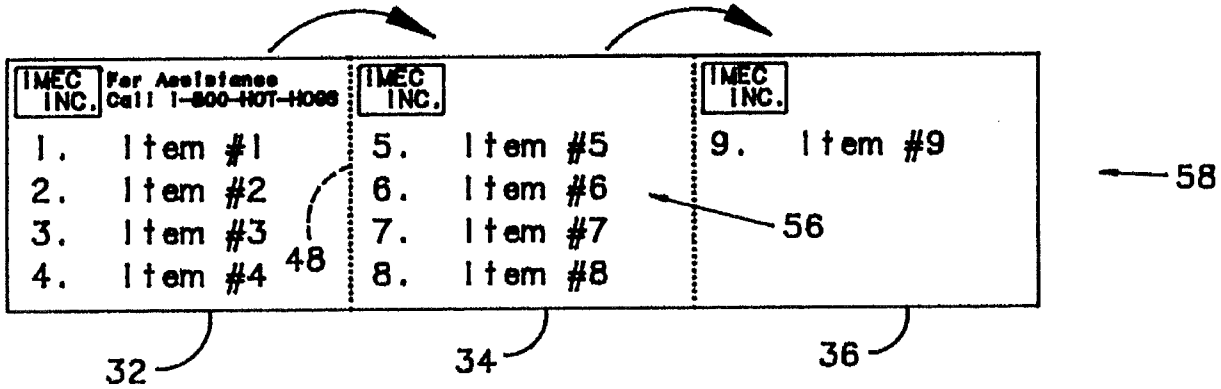
FIG. 13 shows the packing slip portion of the present invention after removal from the article and the unfolding of the three panels.

At the receiving site, the packing list packet 58 is removed from its top and bottom adhesively attached edges and the adjacent panel 30 by tearing along the perforations 48 according to the instructions of use information 52 as shown in FIG. 12. The packing list is then exposed by unfolding the panels 32, 34, and 36 (which are no longer adhesively attached at their top and bottom edges) as shown in FIG. 13.

Thus, it can be seen that the present invention has truly met its stated objectives by providing a single adhesive label strip that acts as an address label, product information label, and packing list.

As those of ordinary skill in the art will undoubtedly realize from the foregoing description, the packing list can be expanded by adding the appropriate number of additional panels on the end of panel 36. All that is required is that as the panels forming the packing list are folded, the next to the last panel have exposed adhesive at the top and bottom edges to seal the packet 58 and that the use information 50 for releasing the packet 58 be on the panel adjacent the address 26.

Wherefore, having thus described the present invention, what is claimed is:

1. A unitary shipping label, product information label, and packing slip comprising:

a) a first strip of a printable medium having a front face and a back face;

b) a second strip of a printable medium having a front face and a back face, said first strip being placed over said second strip in alignment with said back face of said first strip facing said front face of said second strip;

c) a layer of adhesive covering said back face of said first strip;

d) a layer of adhesive release material covering said front face of said second strip whereby said first strip is adhesively held to said second strip by said adhesive but said second strip can be released and removed from said adhesive at the junction of said release material with said adhesive;

e) said first strip and said second strip having transverse perforations therethrough defining first, second, third, and fourth panels; and, f) said second strip having a pair of longitudinal perforations with corresponding slits therethrough defining top and bottom removable strips for said second, third, and fourth panels.

2. The unitary shipping label, product information label, and packing slip of claim 1 wherein:

said front face of said first strip has sender identifying information pre-printed thereon.

3. The unitary shipping label, product information label, and packing slip of claim 1 wherein:

said front face of said first panel of said first strip includes an address label portion for the printing of addressee information thereon and a product identification information portion for printing of product identification thereon.

4. The unitary shipping label, product information label, and packing slip of claim 1 wherein:

a) said front face of said second panel, said third panel, and said fourth panel of said first strip includes a packing list portion for the printing of packing list information thereon; and, b) said back face of said second panel of said second strip has receiver use information for releasing said packing list portion pre-printed thereon.

5. The unitary shipping label, product information label, and packing slip of claim 1 wherein:

a) said front face of said first strip has sender identifying information pre-printed thereon;

b) said front face of said first panel of said first strip includes an address label portion having addressee information printed thereon;

c) said front face of said second panel, said third panel, and said fourth panel of said first strip includes a packing list portion having packing list information printed thereon;

d) said back face of said second panel of said second strip has receiver use information for releasing said packing list portion pre-printed thereon;

e) said top and bottom removable strips of said fourth panel are removed exposing said adhesive;

f) said fourth panel is folded over said third panel; and, g) said fourth panel and said third panel in combination are folded over said second panel adhesively attaching said fourth panel to said second panel along top and bottom edges thereof and placing said receiver use information for releasing said packing list portion adjacent said addressee information.

6. The unitary shipping label, product information label, and packing slip of claim 5 wherein additionally:

a) said second strip is removed from said first panel and said top and bottom removable strips of said second panel are removed exposing said adhesive; and, b) said unitary shipping label, product information label, and packing slip as thus folded is adhesively attached to an article to be shipped.

7. A unitary shipping label, product information label, and packing slip comprising:

a) a strip of a printable medium having a front face and a back face;

b) a layer of adhesive covering said back face of said first strip;

c) a strip of release liner disposed over said strip of a printable medium in alignment therewith whereby said strip of a printable medium is adhesively held to said strip of release liner by said adhesive but said strip of release liner can be released and removed from said adhesive, said strip of release liner having a printable face opposite a side having a releasable face contacting said adhesive;

d) said strip of release liner having transverse perforations therethrough defining first, second, third, and fourth panels; and, e) said strip of release liner having a pair of longitudinal perforations with corresponding slits therethrough defining top and bottom removable strips for said second, third, and fourth panels.

8. The unitary shipping label, product information label, and packing slip of claim 7 wherein:

said front face of said strip of a printable medium has sender identifying information pre-printed thereon.

9. The unitary shipping label, product information label, and packing slip of claim 7 wherein:

a) said front face of said first panel of said strip of a printable medium includes an address label portion for the printing of addressee information thereon.

10. The unitary shipping label, product information label, and packing slip of claim 7 wherein:

a) said front face of said second panel, said third panel, and said fourth panel of said strip of a printable medium includes a packing list portion for the printing of packing list information thereon; and, b) said printable face of said second panel of said strip of release liner has receiver use information for releasing said packing list portion pre-printed thereon.

11. The unitary shipping label, product information label, and packing slip of claim 7 wherein:

a) said front face of said strip of a printable medium has sender identifying information pre-printed thereon;

b) said front face of said first panel of said strip of a printable medium includes an address label portion having addressee information printed thereon;

c) said front face of said second panel, said third panel, and said fourth panel of said strip of a printable medium includes a packing list portion having packing list information printed thereon;

d) said printable face of said second panel of said strip of release liner has receiver use information for releasing said packing list portion pre-printed thereon;

e) said top and bottom removable strips of said fourth panel are removed exposing said adhesive;

f) said fourth panel is folded over said third panel; and, g) said fourth panel and said third panel in combination are folded over said second panel adhesively attaching in said fourth panel to said second panel along top and bottom edges thereof and placing said receiver use information for releasing said packing list portion adjacent said addressee information.

12. The unitary shipping label, product information label, and packing slip of claim 11 wherein additionally:

a) said strip of release liner is removed from said first panel and said top and bottom removable strips of said second panel are removed exposing said adhesive; and, b) said unitary shipping label, product information label, and packing, slip as thus folded is adhesively attached to an article to be shipped.

13. A unitary shipping label, product information label, and packing slip for an article to be shipped comprising:

a) a strip of a printable medium having a front face and a back face;

b) a layer of adhesive covering said back face of said first strip;

c) a strip of release liner disposed over said strip of a printable medium in alignment therewith whereby said strip of a printable medium is adhesively held to said strip of release liner by said adhesive but said strip of release liner can be released and removed from said adhesive, said strip of release liner having a printable face opposite a side having a releasable face contacting said adhesive;

d) said strip of release liner has transverse perforations therethrough defining first, second, third, and fourth panels;

e) said strip of release liner has a pair of longitudinal perforations with corresponding slits therethrough defining top and bottom removable strips for said second, third, and fourth panels;

f) said front face of said strip of a printable medium has sender identifying information pre-printed thereon;

g) said front face of said first panel of said strip of a printable medium includes an address label portion having addressee information printed thereon;

h) said front face of said second panel, said third panel, and said fourth panel of said strip of a printable medium includes a packing list portion having packing list information printed thereon;

i) said printable face of said second panel of said strip of release liner has receiver use information for releasing said packing list portion pre-printed thereon;

j) said top and bottom removable strips of said fourth panel are removed exposing said adhesive;

k) said fourth panel is folded over said third panel;

l) said fourth panel and said third panel in combination are folded over said second panel adhesively attaching said fourth panel to said second panel along top and bottom edges thereof and placing said receiver use information for releasing said packing list portion adjacent said addressee information;

m) said strip of release liner is removed from said first panel and said top and bottom removable strips of said second panel are removed exposing said adhesive; and, n) said unitary shipping label, product information label, and packing slip as thus folded is adhesively attached to the article to be shipped.

14. A unitary shipping label, product information label, and packing slip for an article to be shipped comprising:

a) an adhesive label strip including an adhesive layer and a releasable liner covering said adhesive layer and comprising a first panel portion, a second panel portion, a third panel portion, and a fourth panel portion;

b) addressee information and product identification information printed on said first panel portion;

c) packing list information printed on at least one of said second panel portion, said third panel portion, and said fourth panel portion;

d) said releasable liner having transverse perforations therethrough at junctions of said first panel portion, said second panel portion, said third panel portion, and said fourth panel portion;

e) said releasable liner having a pair of longitudinal perforations and corresponding slits therethrough defining top and bottom removable strips for said second panel portion and said fourth panel portion;

f) said top and bottom removable strips for said fourth panel portion being removed;

g) said fourth panel portion being folded over said third panel portion;

h) said fourth panel portion and said third panel portion in combination being folded over said second panel portion adhesively attaching said fourth panel portion to said second panel portion along top and bottom edges thereof;

i) said releasable liner being removed from said first panel portion and said top and bottom removable strips of said second panel portion being removed; and, j) said unitary shipping label, product information label, and packing slip as thus folded and with portions of said releasable liner thereof as thus removed being adhesively attached to the article to be shipped.

* * * * *